US005524370A

United States Patent [19]

Roy

[11] Patent Number: 5,524,370

[45] Date of Patent: Jun. 11, 1996

[54] SYSTEM FOR ATTACHING A BACKING PLATE TO A PICTURE FRAME STRUCTURE

[75] Inventor: Armand E. Roy, Attleboro, Mass.

[73] Assignee: Craft, Inc., South Attleboro, Mass.

[21] Appl. No.: 355,070

[22] Filed: Dec. 13, 1994

[51] Int. Cl.[6] ..... G09F 1/12

[52] U.S. Cl. ..... 40/748; 40/768

[58] Field of Search ..... 40/152, 152.1, 40/156, 158.1; 24/545, 346

[56] References Cited

U.S. PATENT DOCUMENTS

| | | | |
|---|---|---|---|
| 1,220,418 | 3/1917 | Hawkes . | |
| 3,965,600 | 6/1976 | Paskerian | 40/152.1 |
| 5,253,440 | 10/1993 | Chang | 40/152.1 |

FOREIGN PATENT DOCUMENTS

| | | | |
|---|---|---|---|
| 858346 | 12/1970 | Canada | 24/545 |
| 910268 | 6/1946 | France | 40/156 |
| 2457759 | 6/1976 | Germany | 40/156 |

*Primary Examiner*—Peter M. Cuomo

*Assistant Examiner*—James O. Hansen

*Attorney, Agent, or Firm*—Salter & Michaelson

[57] ABSTRACT

A system for attaching a backing plate to a picture frame structure includes at least one clip releasably attached to the edge of the backing plate, the clip having a member which extends outwardly from the clip along substantially the same plane as the backing plate. The member of the clip is received within a groove formed in the picture frame structure. The system also includes a sliding lock mechanism releasably attached to the edge of the backing plate at a location generally opposite to the location of the clip. The sliding lock mechanism has a sliding lock member movable between a retracted position in which the sliding lock member is retracted inboard with respect to the peripheral edge of the backing plate and an operable position in which the sliding lock member is extended outboard beyond the peripheral edge of the backing plate and into the groove of the picture frame structure. The arrangement is such that the clip and sliding lock member of the sliding lock mechanism, when in its operable position, releasably secure the backing plate to the picture frame structure and by moving the sliding lock member to its retracted position, the backing plate can be removed from the picture frame structure.

10 Claims, 4 Drawing Sheets

SYSTEM FOR ATTACHING A BACKING PLATE TO A PICTURE FRAME STRUCTURE

BACKGROUND AND SUMMARY OF THE INVENTION

This invention relates generally to picture frames and more particularly to a system for attaching a backing plate of a picture frame to a picture frame structure without having to permanently deface the backing plate.

Presently, there are many methods and devices for attaching a backing plate of a picture frame to a picture frame structure. Most of these methods require defacing the backing plate by permanently attaching a device thereto which attaches the backing plate to the frame structure. One such method is illustrated in broken lines in FIG. 1. As shown, several (three are illustrated) rotatable latches are mounted on the backing plate by rosette fasteners or rivets which extend completely through the backing plate. These latches are each rotatable to a position where the latch is disposed within a groove formed in the picture frame structure. Thus, when disposed in the groove, the latch engages the frame structure for securing the backing plate to the frame structure.

The foregoing method of attaching a backing plate to a picture frame structure suffers from the disadvantage that several latches must be permanently affixed to the backing plate. The process of permanently affixing the latch to the backing plate is time-consuming and costly. This method of attachment also suffers from the disadvantage that it is somewhat inconvenient to have to rotate a plurality of separate latches in order to adequately secure the backing plate to the picture frame structure.

Accordingly, among the several objects of the present invention are the provision of an improved system for attaching a backing plate to a picture frame structure which is releasably attached to the backing plate without having to permanently deface the backing plate; the provision of such a system which is not time-consuming when mounting the system on the backing plate; and the provision of such an improved system having one movable latching/locking member for securing the backing plate to the frame structure thereby rendering the process of securing and unsecuring the backing plate to the frame structure much simpler.

In general, a system of the present invention for attaching a backing plate having an outer peripheral edge to a picture frame structure having an opening for receiving a picture or photograph and the backing plate therein, and an inwardly facing groove formed in the picture frame structure which is in communication with the opening, comprises at least one clip releasably attached to the edge of the backing plate. The clip has a member extending outwardly from the clip along substantially the same plane as the backing plate. The member of the clip is received within the groove of the picture frame structure when inserting the backing plate within the opening of the picture frame structure. The system also comprises a sliding lock mechanism releasably attached to the edge of the backing plate at a location generally opposite to the location of the clip. The sliding lock mechanism includes a sliding lock member movable between a retracted position in which the sliding lock member is retracted inboard with respect to the peripheral edge of the backing plate and an operable position in which the sliding lock member is extended outboard beyond the peripheral edge of the backing plate and into the groove of the picture frame structure. The arrangement is such that the clip and sliding lock member of the sliding lock mechanism, when in its operable position, releasably secure the backing plate to the picture frame structure and by moving the sliding lock member to its retracted position, the backing plate can be removed from the picture frame structure.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
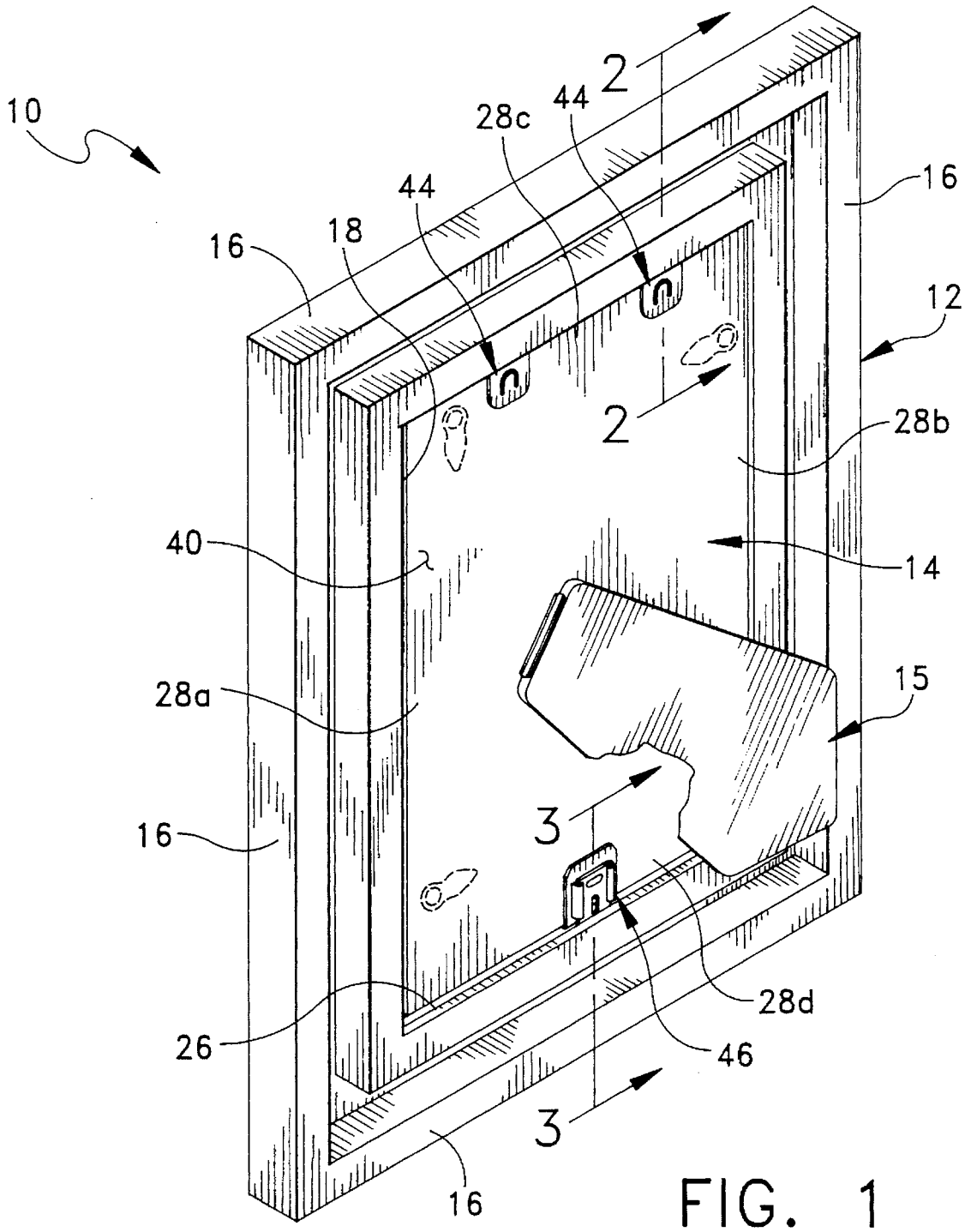
FIG. 1 is a rear perspective view of a picture frame and a system for attaching a backing plate of the picture frame to a picture frame structure.
Figure 2:
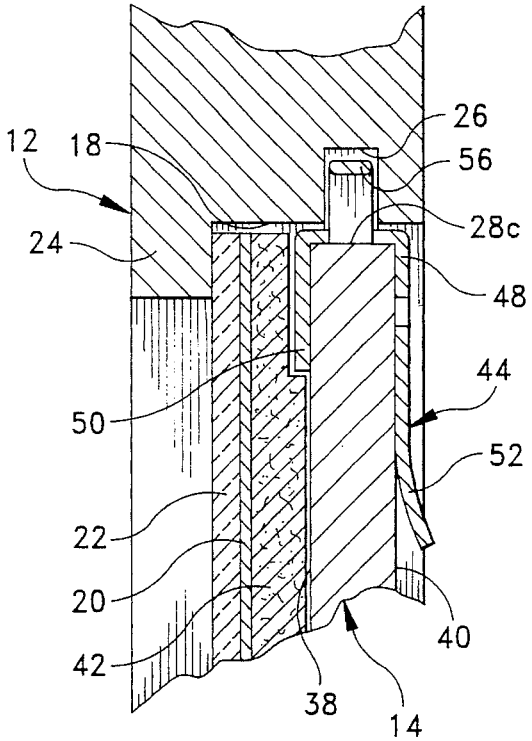
FIG. 2 is a cross-sectional view of a clip of the system taken along line 2—2 of FIG. 1.
Figure 3:
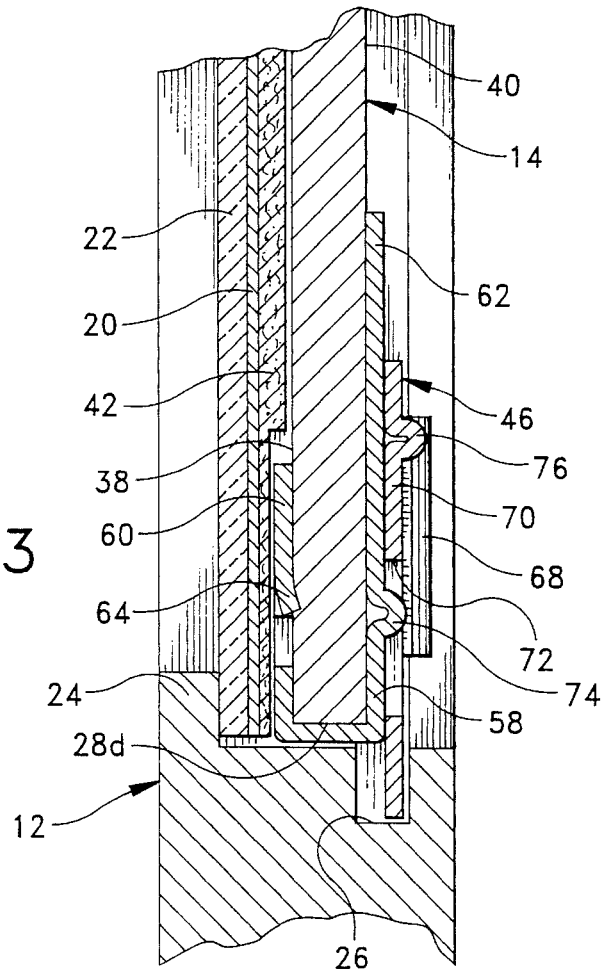
FIG. 3 is a cross-sectional view of a sliding lock mechanism of the system taken along line 3—3 of FIG. 1.

Referring now to the drawings, and more particularly FIGS. 1–3, there is generally indicated at 10 a picture frame having a picture frame structure, generally indicated at 12, a backing plate, generally indicated at 14, and a system of the present invention for attaching the backing plate 14 to the picture frame structure 12. A support leg, generally indicated at 15, hingedly attached to the backing plate 14, supports the picture frame 10 in an upright position, as is well known in the art.

As illustrated, the picture frame structure 12 includes four rail members, each indicated 16, which define a rectangular opening 18 for receiving and displaying a photograph, picture or the like, indicated at 20 in FIG. 3, therein. A rectangular pane of glass 22 is received in the opening 18 in the conventional manner for protecting the photograph 20. The picture frame structure 12 further includes an inwardly extending lip 24 formed in each rail member 16 against which the pane of glass 22 engages when placing the pane in the opening 18. The picture frame structure 12 also has an inwardly facing groove 26 formed in each rail member 16 which is spaced from the lip 24 and in communication with the opening 18. The purpose of the groove 26 will be apparent as the description of picture frame 10 proceeds. The picture frame structure 12 may be fabricated from any material, such as rigid plastic or metal.

The backing plate 14, which is preferably fabricated from cardboard material, is also rectangular and is sized to be received within the opening 18 of the picture frame structure 12 for covering the backside of the opening 18 and for securing the photograph 20 therein. The backing plate 14 has a peripheral edge 28 including two side edges 28*a*, 28*b* and two end edges 28*c*, 28*d*, an inner surface 38 which is positioned adjacent the photograph 20 when the backing plate 14 is covering the backside of the opening 18 of the picture frame structure 12, and an outer surface 40 opposite the inner surface 38. In the illustrated embodiment, the backing plate 14, when disposed within the opening 18 of the picture frame structure 12, engages a sheet of filler material 42 (e.g., corrugated cardboard) which is disposed between the photograph 20 and the backing plate 14. As illustrated, the lip 24 captures the pane of glass 22, photograph 20, sheet of filler material 42, and backing plate 14 in such a manner that the backing plate 14 is generally aligned with the groove 26 of the picture frame structure 12.

For securing the backing plate 14, along with the pane of glass 22, photograph 20, and sheet of filler material 42, within the opening 18 of the picture frame structure, the system comprises two clips, each generally designated 44, releasably securable to the backing plate 14 along its upper end edge 28*c* and a sliding lock mechanism, generally designated 46, releasably securable to the backing plate 14 along its lower end edge 28*d*. As shown, the sliding lock mechanism 46 is attached to the backing plate 14 at a location generally opposite to the location of the two clips 44. It is envisioned that the system of the present invention is suitable for securing backing plates to frame structures of many shapes and sizes (e.g., an oval frame), and not just for the rectangular frame depicted in the drawings.

Figure 5:
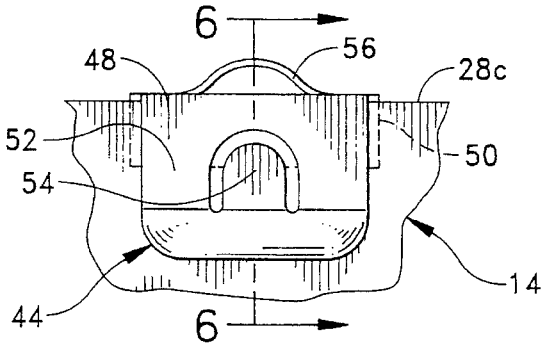
FIG. 5 is an enlarged rear detail view of the clip of the system.
Figure 6:
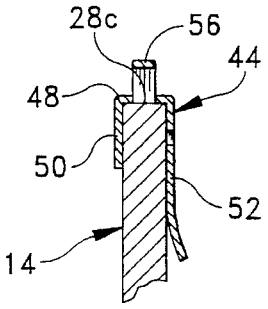
FIG. 6 is a cross-sectional view taken along line 6—6 of FIG. 5.
Figure 7:
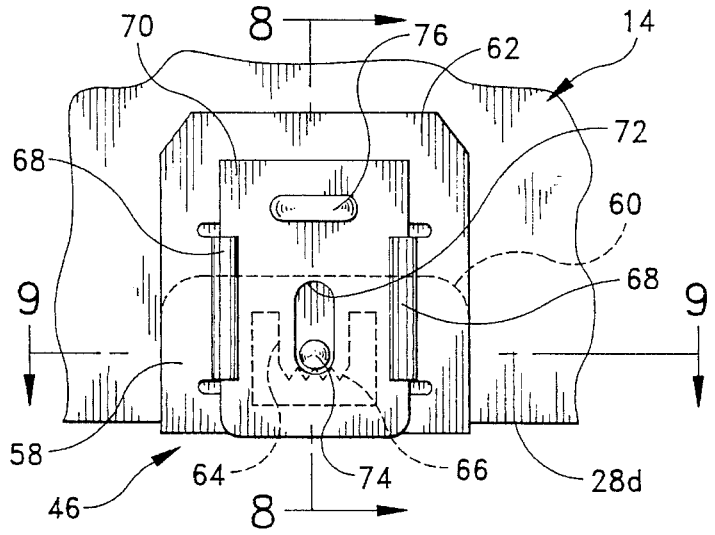
FIG. 7 is an enlarged rear detail view of the sliding lock mechanism of the system.
Figure 8:
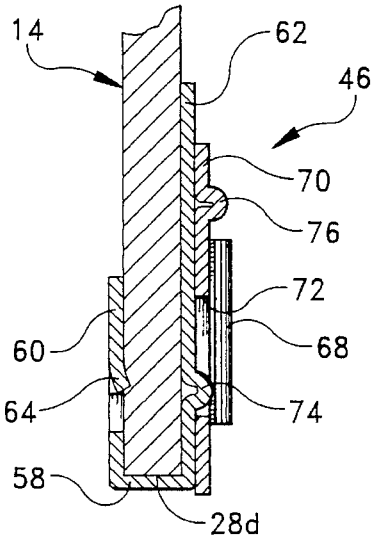
FIG. 8 is a cross-sectional view taken along line 8—8 of FIG. 7.
Figure 9:
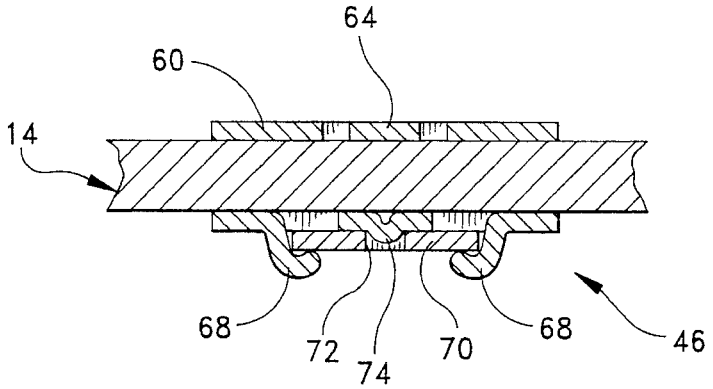
FIG. 9 is a cross-sectional view taken along line 9—9 of FIG. 7.

FIGS. 2, 5 and 6 illustrate the clip 44 of the present invention. Since each clip 44 is of identical construction, a description of one will suffice for both. As illustrated, clip 44 comprises an inverted U-shaped body portion 48 having a pair of downwardly extending legs 50, 52 which define a space therebetween sized for receiving the backing plate 14 therein. The clip 44 is preferably made from spring steel so that the legs 50, 52 of the clip 44 resiliently engage the backing plate 14 for releasably securing the clip 44 thereto. Formed in the longer leg 52 of the clip 44 is a tongue portion 54 which is slightly bent towards the backing plate 14 when the clip 44 is mounted thereon for engaging the backing plate 14. The clip tongue portion 54 is formed from material comprising the longer leg 52.

The clip 44 further comprises an inverted U-shaped member 56 extending upwardly and outwardly from the body portion 48 of the clip 44 along substantially the same plane as the backing plate 14. The member 56 is formed integrally with the body portion 48 of the clip 44 from material removed at junction of the legs 50, 52 and extends in a direction opposite to the direction of the legs. As illustrated in FIG. 2, the member 56 is received within the groove 26 of the picture frame structure 12 when inserting the backing plate 14 within the opening 18 of the picture frame structure 12. The member 56 of each clip 44 secures the upper portion of the backing plate 14 to the upper portion of the picture frame structure 12 and prevents the backing plate's removal therefrom. Since the member 56 has a relatively thin cross section as illustrated in FIGS. 2 and 6, it can be slightly deformed so as to accommodate picture frame structures having minor inconsistencies in length between opposing end rail members.

Turning now to FIGS. 3 and 7–9, the sliding lock mechanism comprises a generally U-shaped body portion 58 having a pair of upwardly extending legs 60, 62 which define a space therebetween for receiving the backing plate 14 therein. As illustrated throughout the drawings, the body portion 58 of the sliding lock mechanism 46 is larger than the body portions 48 of the clips 44. The legs 60, 62 of the sliding lock mechanism body portion 58 resiliently engage the backing plate 14 for releasably securing the sliding lock mechanism 46 thereto. The shorter leg 60 of the body portion 58 has an inwardly extending tongue portion 64 which resiliently engages the backing plate 14 for substantially preventing the unwanted removal of the sliding lock mechanism 46 from the backing plate 14. As illustrated in broken lines in FIG. 7, the tongue portion 64 of the sliding lock body portion 58 has teeth formed in its outer end 66 which engage the backing plate 14. The tongue portion 64, while prohibiting the unwanted removal of the sliding lock mechanism 46 from the backing plate 14, allows the mechanism 46 to be removed from the backing plate 46 without permanently defacing it upon applying a force on the mechanism along the plane of the backing plate 14 in a direction away from the backing plate.

A pair of spaced-apart, inwardly extending fingers, each indicated at 68, are integrally formed from material removed from leg 62 of the body portion 58 of the sliding lock mechanism 46. As illustrated best in FIG. 9, each finger 68 extends outwardly from the outer surface of leg 62 to define a track therebetween for receiving a rectangular sliding lock member 70 therein. The fingers 68 substantially prevent any lateral movement of the sliding lock member 70 while enabling it to move longitudinally with respect to the body portion 58 of the sliding lock mechanism 46. The fingers 68 also frictionally engage the sliding lock member 70 for preventing any unwanted longitudinal movement of the lock member 70.

Figure 4:
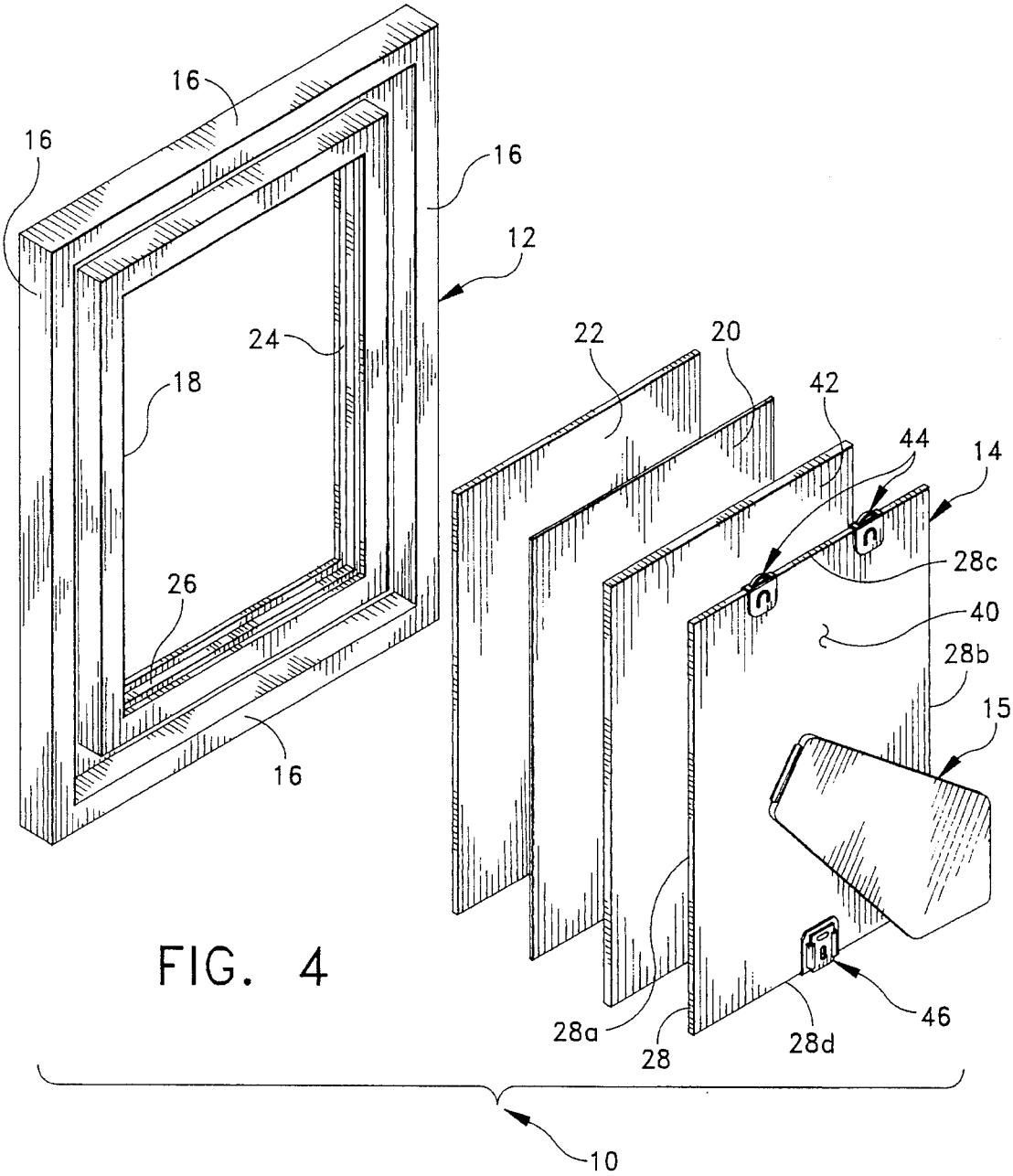
FIG. 4 is an exploded rear perspective view of the picture frame and the system for attaching the backing plate of the picture frame to the picture frame structure, a sliding lock member of the sliding lock mechanism being illustrated in a retracted position.

Turning now to FIGS. 3 and 4, the sliding lock member 70 of the sliding lock mechanism 46 is movable between a retracted or stowed position (FIG. 4) in which the sliding lock member 70 is retracted inboard with respect to the peripheral edge (lower end edge 28*d*) of the backing plate 14, and an operable position (FIG. 3) in which the sliding lock member 70 is extended outboard beyond the peripheral edge 28 of the backing plate 14 and into the groove 26 of the picture frame structure 12. The arrangement is such that the members 56 of clips 44 and the sliding lock member 70 of the sliding lock mechanism 46, when in its operable (extended) position, releasably secure the backing plate 14 to the picture frame structure 12 and by moving the sliding lock member 70 to its retracted position, the backing plate 14 can be removed from the picture frame structure 12.

Referring back to FIGS. 3 and 7–9, the sliding lock member 70 has a slot 72 formed therein which receives a detent 74 formed on the outer surface of leg 62 of the body portion 58 of the sliding lock mechanism 46. The detent 74 extends through the slot 72 of the sliding lock member 70 and engages the sliding lock member 70 at the ends of the slot 72 for limiting the longitudinal movement of the lock member 70 with respect to the body portion 58 thereby prohibiting the removal of the lock member from the body portion. It should be understood that any means of limiting the longitudinal movement of the lock member with respect to the body portion may be provided and that the provision of a detent formed on the body portion of the sliding lock mechanism extending through a slot in the lock member is but one way of preventing the lock member's removal. A thumb grip 76 is further provided for gripping the lock member 70 when moving it between its retracted and operable positions.

In use, the pane of glass 22, photograph 20, and sheet of filler material 42 are inserted into the opening 18 of the picture frame structure 12 until the pane of glass 22 engages the lip 24 formed in the structure 12. The upper end edge 28*c* of the backing plate 14 having the clips 44 is inserted into the opening 18 in such a manner that the members 56 of the clips 44 enter the groove 26 formed in picture frame structure 12 as illustrated in FIG. 2. The backing plate 14 is then pivoted into the opening 18 about the upper end edge 28*c* of the backing plate 14 so that the backing plate bears against the sheet of filler material 42. The retracted sliding lock member 70 of the sliding lock mechanism 46 is then extended to its operable (extended) position wherein the lock member 70 is inserted into the groove 26 of the picture frame structure 12. At this point, the backing plate 14 is secured to the picture frame structure 12 and the picture frame 10 is ready for use. Since the fingers 68 frictionally engage the sliding lock member 70, it maintains its engagement with the picture frame structure 12 within the groove 26.

To remove the backing plate 14 from the picture frame structure 12, the sliding lock member 70 is moved to its retracted position. The backing plate 14 may be pivoted about its upper end edge 28*c* until the lower end edge 28*d* of the backing plate clears the bottom rail member 16 of the picture frame structure 12. The backing plate 14 may then be completely removed from the picture frame structure 12 wherein the members 56 of the clips 44 are backed out of the groove 26.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A picture frame comprising:

a backing plate having an outer peripheral edge;

a picture frame structure having an opening for receiving a picture or photograph and the backing plate therein, and an inwardly facing groove formed in the picture frame structure which is in communication with the opening;

at least one clip releasably attached to the edge of the backing plate, said clip having a member extending outwardly from the clip along substantially the same plane as the backing plate, said member of the clip being received within the groove of the picture frame structure when inserting the backing plate within the opening of the picture frame structure; and a sliding lock mechanism releasably attached to the edge of the backing plate at a location generally opposite to the location of the clip, said sliding lock mechanism including a U-shaped body portion releasably attachable to the edge of the backing plate and a sliding lock member movable relative to the body portion between a retracted position in which the sliding lock member is retracted inwardly with respect to the peripheral edge of the backing plate and an operable position in which the sliding lock member is extended outwardly beyond the peripheral edge of the backing plate and into the groove of the picture frame structure, wherein the clip and sliding lock member of the sliding lock mechanism, when in its operable position, releasably secure the backing plate to the picture frame structure, and by moving the sliding lock member to its retracted position, the backing plate can be removed from the picture frame structure.

2. A picture frame as set forth in claim 1, said clip comprising said generally U-shaped body portion having a pair of legs joined together at a junction to define a space therebetween for receiving the backing plate therein, said legs of the clip resiliently engaging said backing plate for releasably securing the clip thereto.

3. A picture frame as set forth in claim 2, said member of the clip being formed integrally with the body portion of the clip at the junction of the legs, said member extending in a direction generally opposite to the direction of said legs.

4. A picture frame as set forth in claim 1 comprising two clips releasably attached to the edge of the backing plate, said clips being located along the edge adjacent one another, said sliding lock mechanism being releasably attached to the backing plate at a location generally opposite to the location of the two clips.

5. A picture frame as set forth in claim 1, said sliding lock mechanism comprising a generally U-shaped body portion having a pair of legs which define a space therebetween for receiving the backing plate therein, said legs of the sliding lock mechanism body portion resiliently engaging said backing plate for releasably securing the sliding lock mechanism thereto.

6. A picture frame as set forth in claim 5, one of said legs of the body portion of the sliding lock mechanism having an outer surface and a pair of spaced-apart, inwardly extending fingers which extend outwardly from the outer surface of the body portion to define a track therebetween for receiving the sliding lock member therein, said fingers substantially preventing any lateral movement of the sliding lock member while enabling the sliding lock member to move between its retracted and operable positions.

7. A picture frame as set forth in claim 6, said fingers frictionally engaging the sliding lock member for preventing the unwanted movement of the lock member, when in its operable position, to its retracted position.

8. A picture frame as set forth in claim 6, said sliding lock member having a slot having opposite ends formed therein, said outer surface of said one leg of the body portion of the sliding lock mechanism having a detent formed thereon which extends through the slot of the sliding lock member, said detent engaging the sliding lock member at the ends of the slot for limiting the longitudinal movement of the lock member.

9. A picture frame as set forth in claim 5, one of said legs of the body portion of the sliding lock mechanism having an inwardly extending tongue portion which resiliently engages the backing plate for substantially preventing the unwanted removal of the sliding lock mechanism from the backing plate.

10. A picture frame as set forth in claim 9, said tongue portion having teeth formed in its outer end which engage the backing plate.

* * * * *